US005090723A

United States Patent [19]

Arnulf

[11] Patent Number: 5,090,723

[45] Date of Patent: Feb. 25, 1992

[54] LATERAL GUIDANCE DEVICE FOR A CROSS-COUNTRY SKI BOOT

[75] Inventor: Paul Arnulf, Alby Sur Cheran, France

[73] Assignee: Salomon, S.A., Annecy Cedex, France

[21] Appl. No.: 596,008

[22] Filed: Oct. 11, 1990

[30] Foreign Application Priority Data

Oct. 11, 1989 [FR] France ..... 89 13291

[51] Int. Cl.[5] ..... A63C 9/00

[52] U.S. Cl. ..... 280/615; 280/636

[58] Field of Search ..... 293/128; 280/615, 636, 280/614, 607; 52/573, 716

[56] References Cited

U.S. PATENT DOCUMENTS

| | | | |
|---|---|---|---|
| 3,388,523 | 6/1968 | Evans | 293/128 |
| 3,659,887 | 5/1972 | Marquette | 293/128 |
| 4,066,285 | 1/1978 | Hall et al. | 293/128 X |
| 4,408,432 | 10/1983 | Carter et al. | 293/128 X |
| 4,753,467 | 6/1988 | De Caluwe et al. | 293/128 X |

FOREIGN PATENT DOCUMENTS

| | | | |
|---|---|---|---|
| 0096094 | 12/1983 | European Pat. Off. . | |
| 131234 | 1/1985 | European Pat. Off. | 280/615 |
| 2448912 | 9/1980 | France . | |
| 2623094 | 5/1989 | France . | |

*Primary Examiner*—Andres Kashnikow
*Assistant Examiner*—Michael Mar
*Attorney, Agent, or Firm*—Sandler, Greenblum, & Bernstein

[57] ABSTRACT

A lateral guidance device for a ski boot, which is attached at its front end to a ski, for example a cross-country ski. The heel of the boot is free to move, at least vertically, The guidance device includes at least one longitudinal guidance rib cooperating with at least one longitudinal groove of a complementary shape provided in the sole of the boot, in order to assure lateral guidance of the boot. The guidance device includes two elements arranged end to end and aligned along the longitudinal axis of the ski, namely a front element and a rear element. The back side of the front element and the front side of the rear elements are provided with connection elements to assure their transverse and vertical connection, as well as freedom of longitudinal movement.

14 Claims, 2 Drawing Sheets

LATERAL GUIDANCE DEVICE FOR A CROSS-COUNTRY SKI BOOT

BACKGROUND OF THE INVENTION

1. Field of the Invention

The present invention concerns a lateral guidance device for a ski boot, whose front end is attached to a ski, such as a cross-country ski, and whose heel is free to move at least vertically.

2. Description of Background and Other Information

Various devices are already known which assure the lateral guidance of a cross-country ski boot in relation to the ski on which it is mounted. Some of these devices use a lateral guidance rib which is mounted on the upper surface of the ski, or which is integral with it, this rib cooperating with a longitudinal groove of a complementary shape provided in the sole of the cross-country ski boot, in order to assure the lateral guidance of the boot when skiing cross country.

Such lateral guidance ribs are usually embodied on a mounted small plate, generally of a plastic material, which is attached to the upper surface of the ski. Then, these guidance ribs, at least as far as their front part is concerned, are subjected during skiing to significant stress imposed by the front part of the boot. Accordingly the ribs must be made of materials which are very light and very firm, which increases their fabrication costs.

Also, it is extremely difficult to mold such perfectly flat guidance ribs, because of their relatively long length and the differences in height between the rib and its small support plate, which render them particularly sensitive to deformation and retraction. This is why, most of the time, one is constrained to adjoin to a classic screw binding system an adhesive binding intended to apply the base surface of the plates to hold the guidance ribs on the upper surface of the ski. Yet such a gluing operation represents an additional step in production of the product and is thus likely to increase its cost.

In addition, in the case of such a binding on the upper surface of the ski, the addition of a small plate provided with a guidance rib increases the rigidity of the latter and adds to the original rigidity of the ski, thus increasing it by given value. Therefore, less rigidity of the rib is more important.

When skiing, another problem is bending of the ski, which requires a longitudinal displacement of the rib in relation to the binding system.

SUMMARY OF THE INVENTION

The present invention is a lateral guidance device for a ski boot mitigating the different drawbacks cited above.

For this purpose, this lateral guidance device for a ski boot, whose front end is attached on a ski, like a cross-country ski, and whose heel is free to move, at least vertically, including a longitudinal guidance rib cooperating with a longitudinal groove of a complementary shape provided in the sole of the boot, in order to assure the lateral guidance of the boot. The guidance rib includes two elements arranged in and aligned according to a longitudinal axis of the ski, namely the forward and the rear elements, the back side of the front element and the front side of the rear element provided with a means assuring a transverse and vertical connection, and freedom of longitudinal displacement, which allows the problems linked to the bending of the ski to be resolved.

In effect, the fabrication in two separate elements of the lateral guidance device allows the distribution, on the two guidance elements, of the longitudinal displacement caused by such a deformation of the ski.

According to another characteristic of the present invention, the forward element of the lateral guidance device is a rigid material which allows it to resist without difficulty the diverse stresses to which it is subjected by the boot of the skier, for example the polymer marketed under the name "DELRIN", and the rear element which is only subject to weak mechanical stress, is a less resistant and cheaper material, for example polypropylene.

In a variation on the invention, each of the front and rear elements is attached to the ski at only one of its ends, its other end being embedded in an associated part of the binding device or the other element, which permits freedom of longitudinal movement of each of these elements. Advantageously, the rear element covers the binding means of the front element, which prevents snow from getting into the binding means of the front element, and thus avoid the risks of bursting which sometimes occur with freezing.

BRIEF DESCRIPTION OF THE DRAWINGS

The above and additional objects, characteristics, and advantages of the present invention will become apparent in the following detailed description of preferred embodiments, with reference to the accompanying drawings which are presented as non-limiting examples, in which.

DETAILED DESCRIPTION OF PREFERRED EMBODIMENTS

Figure 1:
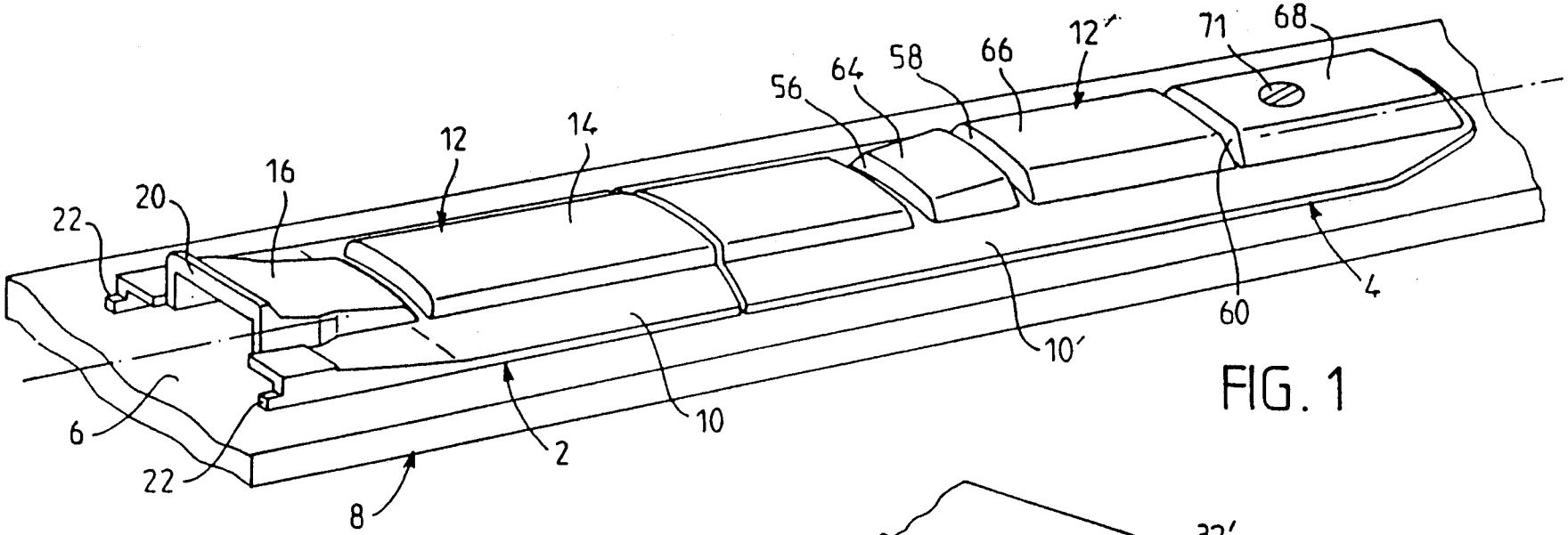
FIG. 1 is a view in perspective of a lateral guidance device mounted on a ski.

The lateral guidance device according to the invention includes of two elements, front element 2 and rear element 4, preferably made of a plastic material and attached end to end on the upper side 6 of a ski 8, following the longitudinal axis of the ski, as represented in FIG. 1. These elements are constituted respectively by a flat base 10, 10' applied on the upper side 6 of the ski 8, on which is formed a longitudinal rib 12, 12' with a polygonal cross-section, and are intended to be placed in a longitudinal groove with a corresponding shape and dimensions, which is provided in the lower part of the sole (not shown in the drawing) of the boot of the skier. The groove extends the entire length of the front element 2 and rear element 4. The rib 12, 12' is hollow inside, and its rigidity is assured by a series of transverse internal Walls 13, 13'.

The rib 12 of the front element 2 has two zones of different heights, namely a rear zone 14 extending between the back of the front element 2 and a transverse groove 18, provided in the rib 12, and a forward zone 16 extending between the transverse groove 18 and the front of the front element 2. The transverse section of the rib 12 is essentially constant, particularly in height, in the rear zone 14, while the rib increases in height from back to front in the forward zone 16. The front side 20 of the front element 2 has two external projections 22, with rectangular sections, extending forward in the lengthwise direction and tangentially to the upper surface 6 of the ski 8, and a central internal projection 23 placed transversely under the upper wall of the zone 16. The external projections 22 are intended to be engaged in associated housings of a binding (not shown) to assure the vertical and transverse hold of the front element 2 with the binding, while allowing free movement in relation to the binding in the lengthwise direction. The internal projection 23 is intended to assure the longitudinal positioning of the rib in relation to the binding by engagement in an appropriate housing of the binding, while guaranteeing a certain longitudinal play necessary for the longitudinal movement of the front element.

Figure 6:
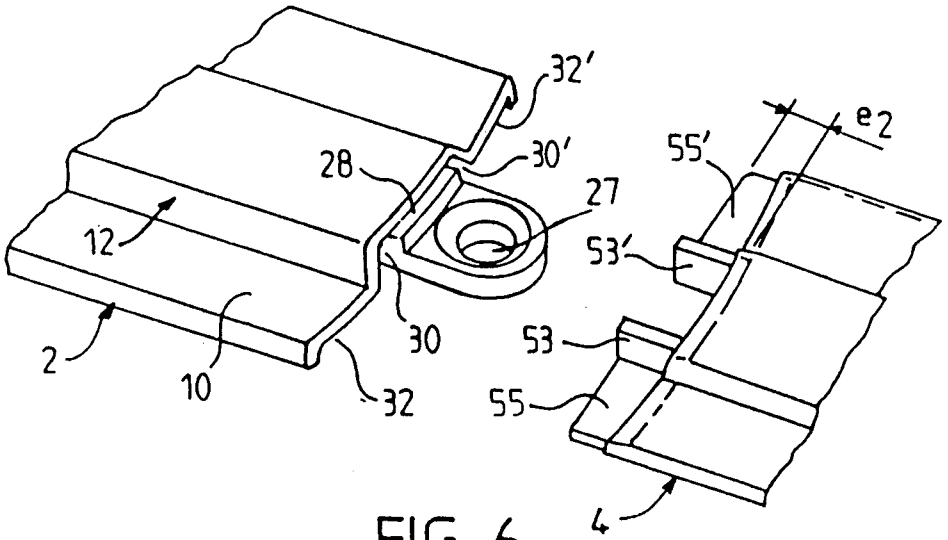
FIG. 6 is a view in partial perspective, on a larger scale, of the element ensuring the interlocking of the forward and rear elements.
Figure 7:
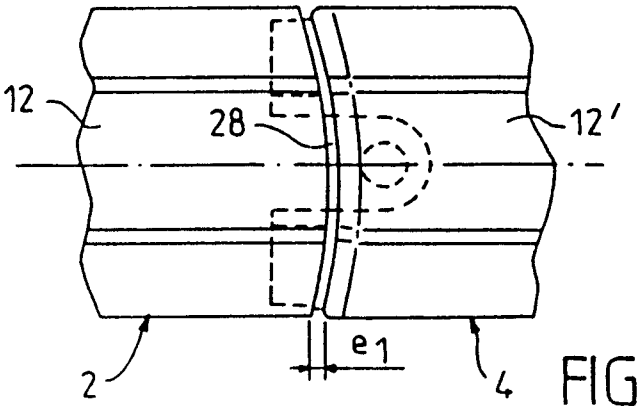
FIG. 7 is a partial top view in a larger scale of the juncture area of the assembled front and rear elements.
Figure 2:
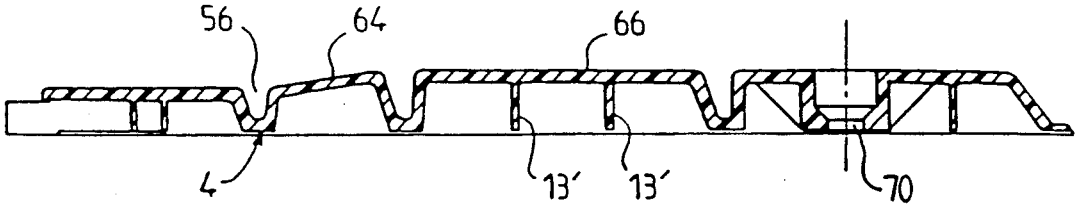
FIGS. 2 and 3 are respectively a top view and vertical cross section of the rear element according to the invention.
Figure 3:
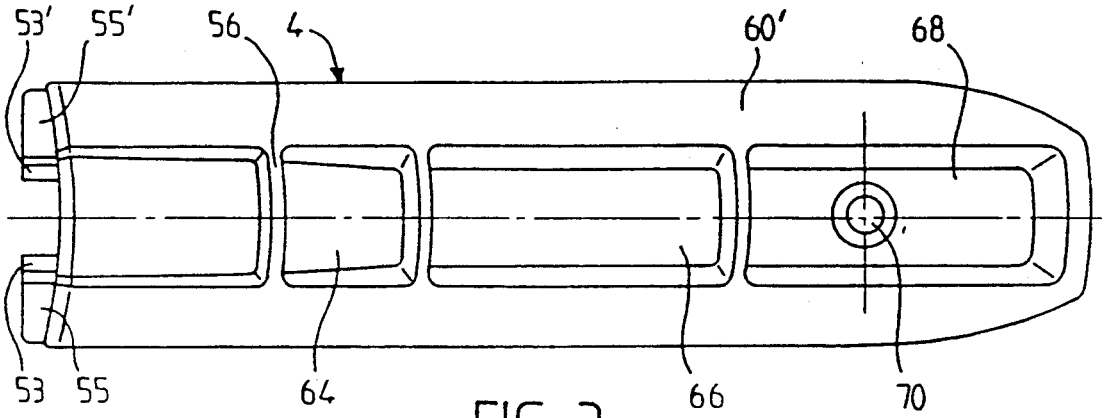
Figure 4:
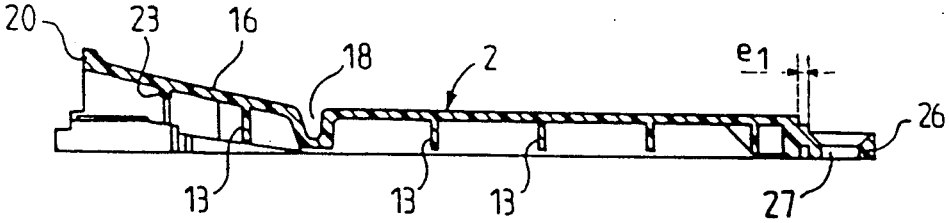
FIGS. 4 and 5 are a longitudinal, vertical cross section, and a top view of the forward element of the device, respectively, according to the invention.
Figure 5:
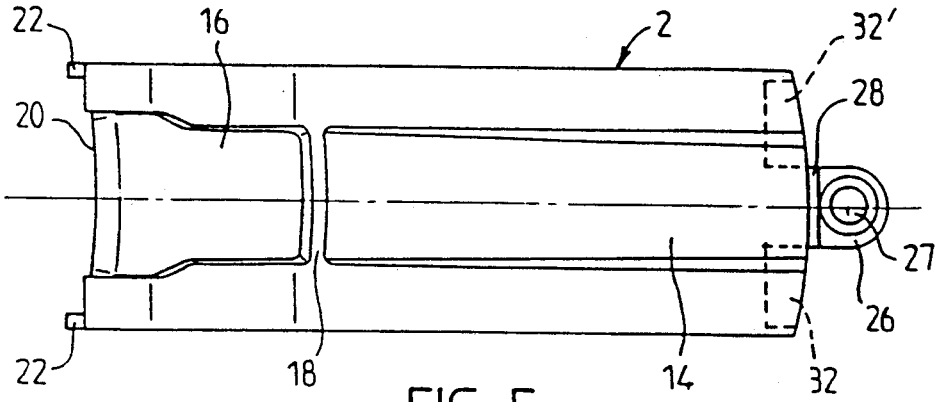

The rear side 24 of the front element 2 is provided with a mounting tongue 26 whose height is less than that of the rear zone 14. The mounting tongue 26 has a hole 27 with a vertical axis, designed to house an attachment screw which is screwed into the ski 8, and a shoulder 28 extending longitudinally at a length $e_1$ which is, at least equal to the possible longitudinal displacement of the rear element 4 in relation, to the front element 2 when the ski flexes. Shoulder 28 extends laterally along the width of the mounting bracket 26. Two housings 30, 30' (see FIG. 6) are provided respectively between the external lateral sides of the mounting bracket 26 and the internal lateral sides of the wall of the rib 12. These housings 30, 30' extend, at the base of the front element 2, towards the lateral edges thereof, by two housings, 32, 32', respectively. Also, the front element 2 is made of a rigid material with high mechanical characteristics, such as "DELRIN", in order to absorb the stress produced during skiing, this stress being exerted essentially on the front guidance elements.

The rear element 4 consists of a plastic material whose mechanical characteristics are less critical, because it is subjected to less stress, and may be chosen mainly because of its price, in the present case, for example, polypropylene.

The front side of the rear element 4 extends forward by two essentially vertical projections 53, 53', extending laterally at the base by two horizontal projections 55, 55', with shapes and dimensions respectively complementary with the housings 30,30' and 32, 32' in the backside of element 2, in which they are intended to be placed, thus assuring the vertical and transverse connection of the rear element 4 with the front element 2, while allowing a longitudinal displacement of rear element 4 in relation to the element 2.

The longitudinal rib 12' of the rear element 4 is separated in four zones of unequal length, by transverse grooves 56, 58 and 60 respectively. The height of these different zones falls between a minimum height equal to the height of the rear zone of the front element 2, and a maximum height essentially equal to twice this height. Thus the height of the first zone 62 is constant and equal to the minimum value, the height of the second zone 64 increases progressively from front to rear, from the minimum height to the maximum height, and the height of the third and fourth zones 66 and 68 is constant and equal to the maximum height. The fourth zone 68 includes a cylindrical hole 70 receiving a binding screw 71 intended to be screwed into the ski 8.

As a result, the front element 2 is attached to the ski by its rear part 26, its forward part able to move longitudinally in relation to the binding, due to the external projections.

The installation of the lateral guidance device, according to the invention, occurs by engaging first of all the external projections 22 of the front part of front element 2 in the binding of ski 8, and then affixing the mounting tongue 26 on the ski by a screw in the hole 27, which is screwed into the ski 8. The rear element 4 is then put in place, by introducing the vertical projections 53, 53' and horizontal projections 5, 55' in the corresponding housings 30, 30' and 32, 32' which are arranged behind the front element 2. The rear element 4 is then interlocked with the ski, by introducing the screw 71 into the hole 70 which is provided behind the rear element 4, and screwed into the ski 8.

The front element 2 and rear element 4 constituting the lateral guidance device, according to the invention, are each affixed on the ski only by their rear ends, which allows them to move freely in the longitudinal direction when the ski bends, thus avoiding any modification of the rigidity of the ski.

According to the invention, the rear element 4 is of variable length so that it is a function of the size of the boot of the skier, so that the two elements placed end to end can assure the guidance function along the entire length of the boot without extending beyond or ending inside the groove, such that the arrangement allows the length of the guidance element to be adapted cheaply to different shoe sizes.

Also, as the rear element 4 covers the mounting tongue 26 and the screw 29 of the front element 2, snow cannot penetrate around the screw 29, which avoids risks of bursting which sometimes occur with freezing.

In addition, the shoulder 28 cooperates with the internal side of the front part of the rear element 4, in order to guarantee the seal of the link between the front element 2 and the rear element 4.

Of course the length e2 of the vertical projections 53, 53' and horizontal projections 55, 55' will be such that the connection between the two guidance elements, in the transverse and vertical directions, is maintained when the ski is subjected to maximum bending, during a relative displacement of these two guidance elements, to guarantee the seal of this connection with respect to the ski.

Finally, although the invention has been described with reference of particular means, materials and embodiments, it is to be understood that the invention is not limited to the particulars disclosed and extends to all equivalents within the scope of the claims.

What is claimed is:

1. A lateral guidance device for a ski boot, the ski boot being attachable at its front end to a ski having a longitudinal axis, so that a heel of the ski boot is free to move at least vertically, the ski boot having at least one longitudinal groove in a sole, said lateral guidance device comprising:

at least one guidance rib cooperating with said at least one longitudinal groove to provide lateral guidance of the boot;

said at least one guidance rib comprising a front element and a separate rear element, said front element and said rear element being generally aligned along the longitudinal axis of the ski;

a rear end of said front element and a front end of said rear element including connecting means to vertically and transversely connect said front and rear elements while allowing relative longitudinal movement between said front and rear elements, said front element and said rear element each including means for substantially fixed attachment being located at the rear end of each of said front and rear elements.

2. The lateral guidance device according to claim 1, substantially said means for fixed attachment being located only at the rear end of each of said front and rear elements.

3. The lateral guidance device according to claim 2, wherein the means for attachment of said front element is covered by said rear element when said front and rear elements are attached to the ski.

4. The lateral guidance device according to claim 2, wherein said front element includes, at a front end, means for connection to a binding.

5. The lateral guidance device according to claim 4, wherein said means for connection to a binding includes at least one projection extending in a longitudinal direction from the front end of said front element for cooperation with at least one respective hollow part of the binding.

6. The lateral guidance device according to claim 5, including two projections for cooperation with two respective hollow parts of the binding.

7. The lateral guidance device according to claim 2, wherein said means for substantially fixed attachment of said front element to the ski includes a mounting tongue extending from the rear side of said front element, said mounting tongue including a hole for receiving a screw.

8. The lateral guidance device according to claim 1, wherein said connecting means includes two projections extending from the front side of said rear element and cooperating with a housing provided in the rear side of said front element.

9. The lateral guidance device according to claim 8, wherein said two projections also extend in a vertical direction.

10. The lateral guidance device according to claim 1, wherein said front element includes an upper inside wall at a front portion thereof, and an internal projection extending vertically from said upper inside wall for cooperation with an associated part of a binding, whereby said front element may be longitudinally moved and positioned with respect to the binding.

11. The lateral guidance device according to claim 1, wherein said connecting means to vertically and transversely connect said front and rear elements is located at a connecting area and includes means to seal the connecting area in relation to the exterior.

12. The lateral guidance device according to claim 1, wherein said means to seal said connecting means includes at least one vertical projection extending from the front side of said rear element and cooperating with a housing in the rear side of said front element, horizontal ribs at a base at the front side of said rear element and cooperating with said housing in the rear side of said front element, a mounting tongue extending form a rear side of said front element, a shoulder on said mounting tongue and extending along substantially the entire width thereof, said shoulder cooperating with an internal surface of an upper front area of said rear element, whereby a sealed connection in said connection area is obtained.

13. The lateral guidance device according to claim 1, wherein said front element and said rear element are made of different materials, the material of said front element having a higher rigidity than the material of said rear element.

14. The lateral guidance device according to claim 1, wherein the length of said rear element is selected depending upon the size of the ski boot.

* * * * *